US005320042A

United States Patent [19]

Schwöpfinger

[11] Patent Number: 5,320,042

[45] Date of Patent: Jun. 14, 1994

[54] PAPER WEB GUIDE ROLLER, PARTICULARLY FOR USE WITH A ROTARY PRINTING MACHINE, TO GUIDE A FRESHLY PRINTED PAPER WEB

[75] Inventor: Hans Schwöpfinger, Augsburg, Fed. Rep. of Germany

[73] Assignee: MAN Roland Druckmaschinen AG, Offenbach am Main, Fed. Rep. of Germany

[21] Appl. No.: 892,043

[22] Filed: Jun. 2, 1992

[30] Foreign Application Priority Data

Jul. 5, 1991 [DE] Fed. Rep. of Germany ..... 4122322

[51] Int. Cl.[5] ..... B41F 35/00; B41L 41/00

[52] U.S. Cl. ..... 101/416.1; 492/30; 492/37; 492/53; 101/417; 101/420

[58] Field of Search ..... 492/30, 37, 53, 56; 101/416.1, 417, 420, 422; 400/611, 617

[56] References Cited

U.S. PATENT DOCUMENTS

| | | | |
|---|---|---|---|
| 1,002,842 | 9/1911 | Harriss | 492/31 |
| 3,597,818 | 8/1971 | Beck | 492/33 |
| 4,083,092 | 4/1978 | Imperial et al. | 492/56 |
| 4,325,998 | 4/1982 | Chapman | 492/48 |
| 4,368,568 | 1/1983 | Watanabe | 492/52 |
| 4,426,757 | 1/1984 | Hourticolon et al. | 492/37 |
| 4,586,224 | 5/1986 | Sartor et al. | 492/31 |
| 4,683,480 | 7/1987 | Sakamoto et al. | 400/617 |
| 5,042,383 | 8/1991 | Wirz | 492/30 |

*Primary Examiner*—Edgar S. Burr
*Assistant Examiner*—Lynn D. Hendrickson
*Attorney, Agent, or Firm*—Frishauf, Holtz, Goodman & Woodward

[57] ABSTRACT

To provide a paper guide roller on which freshly printed ink does not smear while, still, the roller has a surface which is sufficiently rough so that it can be rotated by frictional engagement with a paper web passing thereover, the roller is formed with a base body, typically of steel or cast iron, on which a jacket (3) is placed. In accordance with the present invention, the jacket (3) has two layers, a first layer (4) of ultra-high molecular plastic material, for example polyethylene or polytetrafluorothylene, and a second layer (5) thereover, which has glass balls or beads (6) mixed therein. The material of the second layer can be the same as the first, or different; the glass balls or beads project by a distance of about 20% of their diameter from the second layer. A suitable thickness for the first layer is about 0.3 mm, and the glass balls or beads may have diameters of between 0.2 to 1 mm. The roller is easy to clean since the surface of the glass balls or beads (6) as well as the surface between the glass balls or beads is ink-rejecting or ink-repellent.

13 Claims, 1 Drawing Sheet

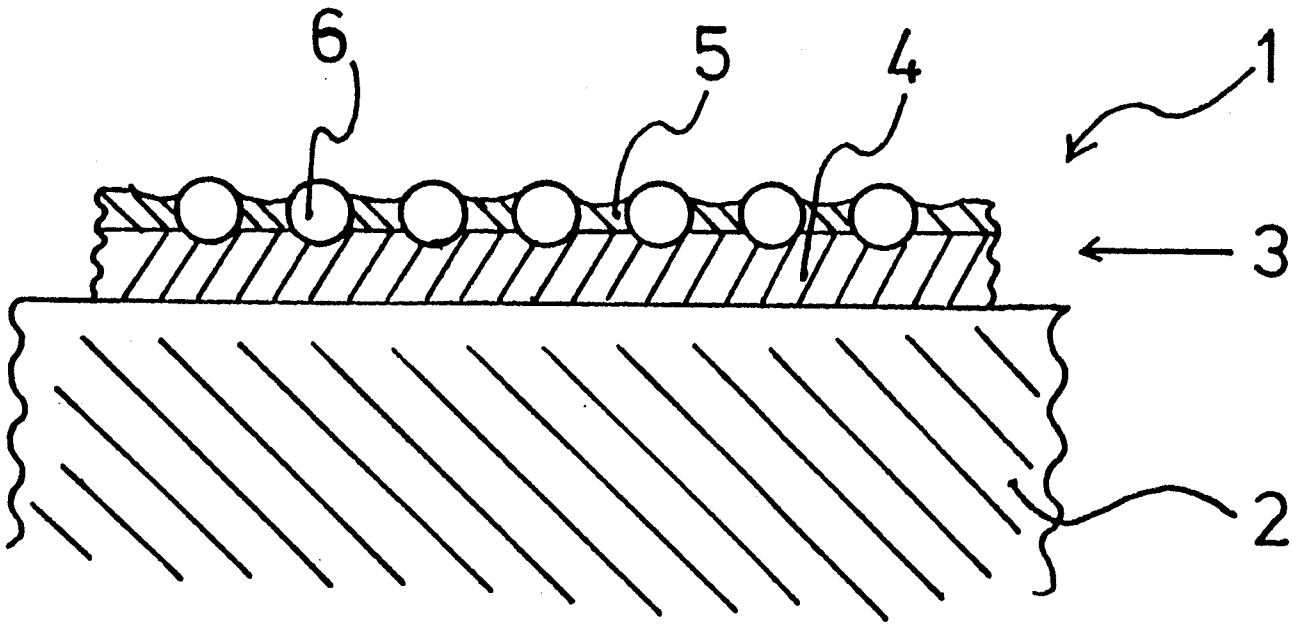
1
3
2
4
5
6

PAPER WEB GUIDE ROLLER, PARTICULARLY FOR USE WITH A ROTARY PRINTING MACHINE, TO GUIDE A FRESHLY PRINTED PAPER WEB

Reference to related publication, assigned to a predecessor organization of the assignee of the present application: German Utility Model G 73 45 259.

FIELD OF THE INVENTION

The present invention relates to rotary printing machines, and more particularly to a paper web guide roller to guide freshly printed paper.

BACKGROUND

Paper guide rollers are used in order to guide paper in predetermined paths. Freshly printed paper webs frequently must be guided in such a way that the freshly printed surface contacts a guide roller. It is difficult to prevent smearing of the freshly printed subject matter as it passes about the guide roller. Typically, such guide rollers are not independently driven but, rather, are carried along by frictional engagement with a paper web passing thereover.

The German Utility Model G 73 45 259 describes a system in which a cylindrical base body, forming a paper guide roller, has a coating thereon, applied by a flame spray process. The coating is a single layer of adjacently positioned droplets projecting from the carrier material. Tiny, essentially funnel-shaped depressions remain between the projecting droplets. These projections, with the funnel-shaped depressions therebetween, furnish a rough surface, so that slip between the frictionally driven roller and the paper web which runs over the roller is effectively avoided. The friction is sufficient to carry along the paper guide roller.

The droplets contain a high percentage of chromium. Thus, the effect is ink repellent. The paper guide roller, however, has a rather coarse, rough surface, and the projecting droplets have sharp edges. Thus, folds or creases in the web rolling off around the roller cannot be compensated. The coarse roughness of the surface of this roller additionally causes difficulties in cleaning.

It has been proposed to use a rubber-like carrier layer and embed glass balls therein, to form a surface cover layer for a guide roller. Such coatings have been referred to as sphere coatings. The glass balls or glass beads form a hard surface which, further, is ink repellent, or oleophobic. Such micro-coated layers can be used only with driven rollers, however, since the surface is too smooth, and does not permit drive of the roller merely by friction with the engaging web. The packing density of the glass balls must be sufficient so that no ink will deposit on the surface of the roller between the glass balls, since the rubber layer has oleophilic characteristics.

THE INVENTION

It is an object to provide a paper guide roller which is highly wear-resistant, and has a surface which is rough, yet fine enough, so that folds or creases in the web can be compensated, which is easy to clean, and still has the degree of roughness which prevents slippage between a web passing about the roller while being rotated by the roller by friction. Slip should be effectively avoided, so that high printing quality is ensured, and deposit of ink on the surface should be prevented or be insignificant.

Briefly, a cylindrical base body has a jacket applied thereto which is formed of two layers. A first layer surrounds the base body, typically a steel or a grey iron casting. In accordance with a feature of the invention. The first layer is an ultra-high molecular plastic material. A second layer also of ultra-high molecular plastic material in which glass balls or beads are mixed is applied over the first layer. Preferably, the ultra-high molecular plastic material of the two layers is the same, but it need not be. The first layer is securely coupled to the base body, and may be bonded thereto. A suitable ultra-high molecular material is polyethylene or polytetrafluoroethylene; using the same material is preferred, although the effect obtained by the present invention is independent of the specific composition of the first and second layers. For example, the first or the layer contacting the base body may be polyethylene, and the second layer, which is the one thereover, may be polytetrafluoroethylene; the reverse arrangement is also suitable.

The respective layers are preferably applied by a thermal spray process, for example by flame spraying. For example, and as well known, one operating step may spray, by means of a flame spray ejector or gun, a relatively fast solidifying layer on the base body. The base body and the material applied should have a sufficient high mutual affinity. A second flame spray gun or ejector, operating subsequently, for example immediately subsequently to the first flame spray gun, then applies the second layer in which small glass balls or glass beads are mixed. The glass balls or beads may have a diameter of from between about 0.2 mm to about 1 mm.

The surface of the jacket surrounding the base body, thus, will be formed with slightly projecting, essentially uniformly distributed glass balls, projecting from the carrier substance. The density and roughness of the outer layer is determined by these glass balls in combination with the underlying layer. The carrier substance for the glass balls as well as for the first layer, preferably polyethylene or polytetrafluorethylene, is ink-repellent, or olephobic, comparable to highly molecular candle wax.

The first layer next to the base body ensures that the glass balls will be embedded deeply enough on the second layer applied thereover. The glass balls or beads, themselves, have the function to prevent the plastic coating formed by the second layer from excessive wear, while ensuring sufficient roughness for frictional drive due to their projection from the carrier substance for the glass balls themselves, that is, the second layer.

DRAWING

The single FIGURE is a highly schematic fragmentary cross-sectional view through a paper guide roller for a rotary printing machine with the friction jacket applied thereover.

DETAILED DESCRIPTION

The paper guide roller 1 has a cylindrical base body 2, for example of cast iron or steel. A jacket 3 is placed thereover. In accordance with a feature of the invention, the jacket 3 has a first layer 4 of high molecular plastic material. Over the layer 4, a second layer 5 is placed, and forms the surface of the jacket 3. The second layer 5 is of the same material as the material of the layer 4, that is, likewise a high molecular plastic material, in which glass balls or glass beads 6 are mixed in, so that they are surrounded and embedded in the layer 5, while projecting slightly therefrom.

Suitable dimensions for the layers:

thickness of the first layer 4: about 0.3 mm;

diameter of glass balls 6 in the second layer 5: between about 0.2 to 1 mm.

In a typical example, glass balls having a diameter of 0.3 mm are used, which project by about 20% of their diameter from the surface of the second layer 5. An average number of about 70 of such balls per square centimeter, are distributed therein.

As shown in the drawing, the second layer 5 is somewhat thinner than the diameter of the glass balls 6, so that the glass balls 6 will be embedded in the second layer 5 in form of a single layer. The glass balls 6 can embed themselves partially within the first layer 4, so that excellent embedding of the ink-rejecting plastic layer is obtained. The projection of the glass balls from the surface of the paper guide roller 1, which is round, and the small distance between the upper projection of the balls and the surface of the layer 5, which is the depth of roughness of the layer 5, ensures easy cleaning of the roller 1.

The density of the glass balls and the second layer 5 is loose enough to ensure adequate friction and prevent slippage between a web passed over the roller while, further, ensuring that ink will not deposit on the roller due to the ink-rejecting or oleophobic characteristics of the balls as well as of the carrier substance therefor.

I claim:

1. Paper web guide roller, for use in rotary printing machines, to guide a freshly printed paper web thereover by frictional engagement with said paper web, having an outer surface which has a surface roughness for frictional engagement, without slippage, with said web, while being ink repellent, having a cylindrical base body (2) and a jacket (3) securely coupled to the base body (2), wherein, in accordance with the invention, the jacket (3) comprises two layers superposed above each other, wherein a first layer (4) surrounds the base body (2), said first layer comprising a high molecular plastic material having high mutual affinity with said cylindrical base body (2); and a second layer (5) surrounds the first layer (4), said second layer comprising a high molecular plastic ink repellent material, and glass balls or beads (6), each having a diameter of between approximately 0.2 to 1 mm, mixed into the high molecular plastic material in a single layer, and and wherein the glass balls or beads (6) are embedded in said second layer (5) and project by up to approximately 20% of their diameter from the surface of the high molecular plastic material of the second layer (5), and are distributed in said material by up to approximately 70 balls or beads (6) per square centimeter.

2. The roller of claim 1, wherein the plastic material of the first and second layers (4, 5) is the same.

3. The roller of claim 1, wherein the base body (3) comprises steel or cast iron.

4. The roller of claim 2, wherein the base body (3) comprises steel or cast iron.

5. The roller of claim 1, wherein the high molecular plastic material of at least one of said layers (4, 5) comprises polyetheylene.

6. The roller of claim 1, wherein the ultra-high molecular plastic material of at least one of said layers (4, 5) comprises polytetrafluoroethylene.

7. The roller of claim 1, wherein the high molecular material of the first layer (4) and the high molecular material of the second layer (5), in which the glass balls or beads (6) of the jacket (3) are mixed, comprise polyethylene.

8. The roller of claim 1, wherein the high molecular material of the first layer (4) and the high molecular material of the second layer (5), in which the glass balls or beads (6) of the jacket (3) are mixed, comprise polytetrafluoroethylene.

9. The roller of claim 1, wherein the thickness of the first layer (4) is approximately 0.3 mm.

10. The roller of claim 1, wherein the diameter of the glass balls or beads (6) is approximately 0.3 mm.

11. The roller of claim 9, wherein the diameter of the glass balls or beads (6) is approximately 0.3 mm.

12. The roller of claim 1, wherein the thickness of the second layer (5) is less than the diameter of the glass balls or beads (6).

13. The roller of claim 9, wherein the thickness of the second layer (5) is less than the diameter of the glass balls or beads (6).

* * * * *